US009422927B2

(12) United States Patent
Tanigawa et al.

(10) Patent No.: US 9,422,927 B2
(45) Date of Patent: Aug. 23, 2016

(54) SWASH PLATE FOR SWASH PLATE COMPRESSOR AND SWASH PLATE COMPRESSOR

(75) Inventors: Naonari Tanigawa, Mie (JP); Yoshio Oki, Mie (JP); Norikazu Muneda, Mie (JP)

(73) Assignee: NTN CORPORATION, Osaka (JP)

( * ) Notice: Subject to any disclaimer, the term of this patent is extended or adjusted under 35 U.S.C. 154(b) by 664 days.

(21) Appl. No.: 13/824,706

(22) PCT Filed: Sep. 21, 2011

(86) PCT No.: PCT/JP2011/071479

§ 371 (c)(1),
(2), (4) Date: Mar. 18, 2013

(87) PCT Pub. No.: WO2012/043336

PCT Pub. Date: Apr. 5, 2012

(65) Prior Publication Data

US 2013/0174724 A1 Jul. 11, 2013

(30) Foreign Application Priority Data

Sep. 28, 2010 (JP) ..... 2010-217647
Aug. 4, 2011 (JP) ..... 2011-171144

(51) Int. Cl.
*C10M 125/22* (2006.01)
*F04B 27/08* (2006.01)
(Continued)

(52) U.S. Cl.
CPC ..... *F04B 27/086* (2013.01); *C10M 169/04* (2013.01); *F04B 27/0886* (2013.01);
(Continued)

(58) Field of Classification Search
None
See application file for complete search history.

(56) References Cited

U.S. PATENT DOCUMENTS 5,486,299 A * 1/1996 Fuwa ..... C10M 169/04 508/106
6,694,864 B2 * 2/2004 Kato ..... F04B 27/1054 228/115

(Continued)

FOREIGN PATENT DOCUMENTS

JP 52-5950 B2 2/1977
JP 08-199327 A 8/1996

(Continued)

OTHER PUBLICATIONS

Anton van Beek, Solid Lubricants / Dry Lubrication, http://www.tribology-abc.com/abc/solidlub.htm.*

(Continued)

*Primary Examiner* — Nathaniel Wiehe
*Assistant Examiner* — Dustin T Nguyen
(74) *Attorney, Agent, or Firm* — Hedman & Costigan, P.C.; James V. Costigan; Kathleen A. Costigan

(57) ABSTRACT

A swash plate, for a swash plate compressor, which is excellent in resistance to the occurrence of seizing in a condition where an extreme pressure is generated owing to local contact between the swash plate and a shoe which slides thereon and in a condition where lubricating oil is depleted, capable of preventing cavitation-caused erosion of a resin film when the swash plate is operated at a high surface pressure and a high speed in the presence of the lubricating oil and the swash plate compressor having the swash plate. A swash plate (3) for a swash plate compressor is so constructed that inside a housing (1) where a refrigerant is present, the refrigerant is compressed and expanded by converting a rotational motion of the swash plate (3) mounted perpendicularly and obliquely on a rotational shaft (2).

17 Claims, 4 Drawing Sheets

(51) Int. Cl.
*C10M 169/04* (2006.01)
*F04B 27/10* (2006.01)

(52) U.S. Cl.
CPC ..... *F04B27/0895* (2013.01); *F04B 27/1054* (2013.01); *C10M 2201/041* (2013.01); *C10M 2213/062* (2013.01); *C10M 2213/0623* (2013.01); *C10M 2217/044* (2013.01); *C10M 2217/0443* (2013.01); *C10N 2220/306* (2013.01); *C10N 2230/06* (2013.01); *C10N 2240/30* (2013.01); *C10N 2250/08* (2013.01); *F05C 2203/0808* (2013.01); *F05C 2225/04* (2013.01); *F05C 2253/12* (2013.01); *F05C 2253/20* (2013.01)

(56) References Cited

U.S. PATENT DOCUMENTS 6,921,205 B2 * 7/2005 Kanayama ..... F04B 27/0873 384/13
2005/0284203 A1 * 12/2005 Takekoshi ..... B21D 22/04 72/204
2009/0082232 A1 * 3/2009 Ikeda ..... C10M 171/008 508/108

FOREIGN PATENT DOCUMENTS

| | | | | | |
|---|---|---|---|---|---|
| JP | 2002-089437 | A | | 3/2002 | |
| JP | 2003-138287 | A | | 5/2003 | |
| JP | 2006-226180 | A | | 8/2006 | |
| JP | 2008-133815 | | * | 6/2008 | ..... F04B 27/06 |
| JP | 2008-133815 | A | | 6/2008 | |
| JP | 2009-062935 | A | | 3/2009 | |
| JP | 2009-209727 | A | | 9/2009 | |
| WO | 2002-075172 | A1 | | 9/2002 | |
| WO | 2009-110378 | A1 | | 9/2009 | |

OTHER PUBLICATIONS

JP2008133815 Espacenet Machine Translation.*

* cited by examiner

SWASH PLATE FOR SWASH PLATE COMPRESSOR AND SWASH PLATE COMPRESSOR

TECHNICAL FIELD

The present invention relates to a swash plate for a swash plate compressor for use in an air conditioner and the like and the swash plate compressor.

BACKGROUND ART

The swash plate compressor is so constructed that inside a housing where a refrigerant is present, the refrigerant is compressed and expanded by converting a rotational motion of a swash plate mounted perpendicularly and obliquely on a rotational shaft by directly fixing the swash plate thereto or indirectly fixing the swash plate thereto through a coupling member into a reciprocating motion of a piston through a shoe which slides on the swash plate. The swash plate compressor is classified into a double swash plate type of compressing and expanding the refrigerant at both sides of the swash plate by using a double head type piston and a single swash plate type of compressing and expanding the refrigerant at one side thereof by using a single head type piston. The shoe includes a type which slides on only one side surface of the swash plate and a type which slides on both side surfaces thereof.

In an early stage of operations of the swash plate compressors, there is a case in which the metallic shoe slides on the metallic swash plate before lubricating oil reaches the inside of the housing in which the refrigerant is present. The sliding-contact portion of the shoe and that of the swash plate have a dry lubricated state in which the lubricating oil is not supplied to the sliding-contact portions. As a result, the sliding-contact portions are liable to seize.

As a means for preventing the occurrence of the seizing, there is proposed the metallic swash plate having the metallic material made of copper or aluminum thermal sprayed to the sliding contact surface thereof on which the shoe slides and the lead-plated layer, the tin-plated layer or the layer plated with the lead-tin alloy disposed on the thermal sprayed metallic layer or the coating layer of polytetrafluoroethylene (hereinafter referred to as PTFE resin), molybdenum disulfide or the mixture of the molybdenum disulfide and graphite (see patent document 1) disposed on the thermal sprayed metallic layer. In addition, there is proposed the swash plate having the lubricating film composed of the solid lubricant such as the molybdenum disulfide or the PTFE resin, the transfer amount adjusting agent such as the earthly graphite, and the binder such as polyamide imide (hereinafter referred to as PAI resin). The lubricating film is formed on the sliding contact surface of the swash plate (see patent document 2) through the intermediary of the thermal sprayed film of aluminum. There is proposed the other swash plate having the sliding-contact layer composed of 10 to 40 vol % of the PTFE resin hardened with the thermosetting resin such as the PAI resin (see patent document 3).

The object of forming the copper-based or aluminum-based thermal sprayed layer between the metallic base material of the swash plate and the resin lubricating film is to prevent the resin lubricating film from peeling from the base material in the case where the resin lubricating film seizes. By using the copper-based or aluminum-based soft metal, the shoe is prevented from sliding directly on the metallic base material, even though the resin lubricating film wears. Thereby the irreversible occurrence of the seizing is prevented.

In the swash plate compressor, being developed in recent years, in which the pressure reaches 8 to 10 MPa owing to the use of carbon dioxide as the refrigerant, the shoe slides on the swash plate at a pressure higher than the pressure acting therebetween in conventional compressors. Thus this type of the swash plate compressor has a problem that the sliding portion of the swash plate is liable to seize to a higher extent than the sliding portion of the conventional swash plate.

There is proposed the following swash plate for the swash plate compressor which is excellent in the resistance to the occurrence of seizing without forming the thermal sprayed layer on the base material thereof and durable in the case where the swash plate is used for the swash plate compressor in which the carbon dioxide is used as the refrigerant. Both surfaces of the base plate of the swash plate consisting of the rolled steel plate disk-shaped by subjecting the steel plate to pressing processing is subjected to grinding processing to form both surfaces as sliding contact surfaces on which the shoe slides. The coating layer, consisting of low friction resin, which contains 40 to 50 wt % of fluororesin is formed on the sliding contact surfaces (see patent document 4).

There is proposed another swash plate, for the swash plate compressor, which is durable in the case where the swash plate is used for the swash plate compressor in which carbon dioxide is used as the refrigerant. The spotty or streaky concave portion is formed on the sliding contact surface of the swash plate on which the shoe slides to hold the lubricating oil in the concave portion and improve the friction and wear property of the sliding contact surface of the swash plate (see patent document 5).

PRIOR ART DOCUMENTS

Patent Documents

Patent document 1: Japanese Patent Application Laid-Open No. 08-199327
Patent document 2: Japanese Patent Application Laid-Open No. 2002-089437
Patent document 3: Japanese Patent Application Laid-Open No. 2003-138287
Patent document 4: Japanese Patent Application Laid-Open No. 2009-209727
Patent document 5: Japanese Patent Application Laid-Open No. 2008-133815

SUMMARY OF THE INVENTION

Problem to be Solved by the Invention

To form the thermal sprayed layer consisting of the copper-based or aluminum-based material on the surface of the base plate as the intermediate layer to obtain the effect of anchoring the lubricating film to the base plate has a problem that the swash plate has a high cost and that the flatness degree of the swash plate deteriorates.

The swash plate compressor mounted on an air conditioner for a private automobile is demanded to save energy, be lightweight, and be compact to a higher extent. A decrease in the diameter of the shoe has a problem that the shoe locally contacts the swash plate to generate seizing.

Further because the swash plate compressor is mounted on electric cars, the swash plate compressor is strongly demanded to have a low friction property in association with electrification. But there is a problem that the swash plate satisfying the balance among its low friction property, wear resistance, and the strength of adhesion of the film to the swash plate having the film formed thereon has not been obtained.

In recent years, the swash plate compressor has become lightweight and compact. Thus the specification of the swash plate has come to be so altered that the swash plate is compact and is operated at a higher speed and under a higher load. In the case where the swash plate makes a sliding contact with the shoe at a high surface pressure and a high speed, there is formed an environment in which a cavitation (impact caused by rupture of generated bubble) is liable to be generated in the lubricating oil. Therefore the swash plate is demanded to be resistant to the occurrence of the cavitation to prevent the film on which the shoe slides from being eroded.

The present invention has been made to deal with the above-described problems. Therefore it is an object of the present invention to provide a swash plate, for a swash plate compressor, which is resistant to the occurrence of seizing in a condition where an extreme pressure is generated owing to local contact between the swash plate and a shoe which slides thereon and in a condition where lubricating oil is depleted, capable of preventing cavitation-caused erosion of a resin film when the swash plate is operated at a high surface pressure and a high speed in the presence of the lubricating oil, and capable of satisfying its low friction property, wear resistance, cavitation resistance, the strength of adhesion of the resin film, and cost in a favorable balance and the swash plate compressor having the swash plate.

Means for Solving the Problem

A swash plate of the present invention for a swash plate compressor is so constructed that inside a housing where a refrigerant is present, the refrigerant is compressed and expanded by converting a rotational motion of the swash plate mounted perpendicularly and obliquely on a rotational shaft by directly fixing the swash plate to the rotational shaft or indirectly fixing the swash plate to the rotational shaft through a coupling member into a reciprocating motion of a piston through a shoe which slides on the swash plate. A resin film containing a matrix resin and at least fluororesin and graphite is formed on a sliding contact surface of the swash plate on which the shoe slides. The resin film contains 25 to 70 parts by weight of the fluororesin and 1 to 20 parts by weight of the graphite for 100 parts by weight of the matrix resin and has a tensile shear adhesive strength (conforming to JIS K6850) of not less than 25 MPa.

The matrix resin is polyamideimide resin. The fluororesin is PTFE resin. The graphite is composed of not less than 97.5% of fixed carbon. The graphite is artificial graphite composed of not less than 98.5% of the fixed carbon.

Abase material of the swash plate is subjected to shot blast treatment at a portion thereof, constituting a ground of the resin film, which is disposed directly under the resin film. The base material of the swash plate consists of SAPH440C.

The base material of the swash plate consists of a rolled steel plate disk-shaped by subjecting the steel plate to pressing processing. Both surfaces of the disk-shaped steel plate is subjected to grinding processing and thereafter the above-described shot blast treatment. The grinding processing is performed by a double head grinding machine.

A surface of the resin film is subjected to grinding processing by the double head grinding machine The grinding processing is carried out by a drive-type double head grinding method of simultaneously grinding upper and lower surfaces of the disk-shaped steel plate which are sliding contact surfaces with a grinding stone, while the disk-shaped steel plate is being rotated with its axis being held.

A flatness of the surface of the resin film subjected to the grinding processing is set to not more than 15 μm and a parallelism of the surface thereof is set to not more than 15 μm. The flatness and the parallelism are defined in JIS B0182.

Surface roughness of the swash plate subjected to the grinding processing is 0.1 to 1.0 μmRa. The surface roughness is defined in JIS B0601.

The swash plate has an oil pocket on a sliding contact surface thereof on which the shoe slides. The oil pocket is a spotty or streaky concave portion. The spotty or streaky concave portion has parallel linear, lattice-shaped, spiral, radial or circular configuration.

An area of a plain portion of the sliding contact surface of the swash plate on which the shoe slides is set to 10 to 95% of an entire area of the sliding contact surface except an area of the oil pocket. A depth of the oil pocket is set to 0.1 mm to 1 mm.

A swash plate compressor of the present invention is so constructed that inside a housing where a refrigerant is present, the refrigerant is compressed and expanded by converting a rotational motion of the swash plate mounted perpendicularly and obliquely on a rotational shaft by directly fixing the swash plate to the rotational shaft or indirectly fixing the swash plate to the rotational shaft through a coupling member into a reciprocating motion of a piston through a shoe which slides on the swash plate. As the above-described swash plate, the swash plate of the present invention is used. The refrigerant is carbon dioxide.

Effect of the Invention

The resin film containing the matrix resin and at least the fluororesin and the graphite is formed on the sliding contact surface of the swash plate of the present invention on which the shoe slides. The resin film contains 25 to 70 parts by weight of the fluororesin and 1 to 20 parts by weight of the graphite for 100 parts by weight of the matrix resin. The tensile shear adhesive strength of the resin film is set to not less than 25 MPa. Therefore the resin film is low in its friction property, high in its wear resistance and tensile shear adhesive strength, and high in the adhesion of the resin film to the base material of the swash plate. Thus the swash plate is durable in the case where the swash plate is used for the swash plate compressor in which the surface pressure applied to the swash plate is not less than 10 MPa without the resin film peeling from the base material of the swash plate. Furthermore because the swash plate is excellent in its cavitation resistance, the swash plate is capable of preventing the occurrence of the cavitation-caused erosion of the resin film in the presence of the lubricating oil.

Because the matrix resin is the PAI resin, the resin film is excellent in its heat resistance, wear resistance, and the adhesion thereof to the base material of the swash plate. The fluororesin is the PTFE resin. The graphite is composed of not less than 97.5% of the fixed carbon. Because the fluororesin and the graphite are easily obtainable and comparatively inexpensive, the swash plate of the present invention can be produced at a low cost. Because the artificial graphite to be used in the present invention is composed of not less than 98.5% of the fixed carbon, the graphite of the present invention is excellent in its lubricating property.

Because the base material of the swash plate is subjected to the shot blast treatment at the portion thereof, constituting the ground of the resin film, which is disposed directly under the resin film, the strength of the adhesion between the base material and the resin film is allowed to be high without forming the intermediate layer such as the thermal sprayed metal layer on the base material. In addition, because the base material of the swash plate is made of SAPH440C which can be subjected to pressing processing, it is possible to simplify the process of the production of the swash plate, which leads to cost reduction.

The base material of the swash plate consists of the rolled steel plate disk-shaped by subjecting the steel plate to the pressing processing. After both surfaces of the disk-shaped steel plate are subjected to the grinding processing, the base material of the swash plate is shot blasted, as described above. Therefore the base material of the swash plate can be processed with high accuracy. Thereby it is possible to carry out a post step (grinding step) and an assembling step with high accuracy, which preferably affects the accuracy of finishing of the swash plate. Further because the grinding processing is performed by the double head grinding machine, it is possible to process the parallelism between both surfaces of the base material of the swash plate with high accuracy, which preferably affects the accuracy of finishing of the swash plate. The above-described grinding processing allows the flatness degree of the surface of the base material of the swash plate to be high. Thereby there is little nonuniformity in the thickness of the resin film formed on both surfaces of the swash plate. Thus it is easy to control the thickness of the resin film so as to prevent the thickness thereof from becoming nonuniform at the step of performing grinding processing of the resin film.

Because the surface of the resin film is subjected to the grinding processing (finish processing) by the double head grinding machine, it is possible to process the parallelism between both sliding contact surfaces of the swash plate with high accuracy. Because the surface roughness of the resin film subjected to the grinding processing is set to 0.1 to 1.0 μmRa, an actual contact area of the sliding contact surface of the resin film on which the shoe slides becomes large. Thereby an actual surface pressure can be decreased. Thus it is possible to prevent the sliding contact surface of the resin film from seizing.

Because the swash plate has the oil pocket on its sliding contact surface on which the shoe slides, it is possible to compensate a lubricating action at a time when the sliding contact surface of the swash plate is lubricated by dilute lubricating oil. Because the area of the plain portion of the sliding contact surface of the swash plate on which the shoe slides is set to 10 to 95% (surface contact ratio) of the entire area of the sliding contact surface except the area of the oil pocket, it is possible to prevent the amount of the lubricating oil from becoming short. Because the depth of the oil pocket is set to 0.1 mm to 1 mm, the oil pocket is excellent in the effect of holding the lubricating oil.

The swash plate compressor of the present invention has the swash plate having the above-described form. Therefore in the case where a shoe having a small diameter locally contacts the swash plate, in the case where an inexpensive shoe which is made of SUJ2 or the like and is not specially treated is used, and in the case where the lubricating oil is depleted, the swash plate is excellent in its resistance to the occurrence of the seizing and capable of avoiding seizing-caused troubles. Thus the swash plate compressor is safe and has a long life. In addition, because the swash plate compressor of the present invention can meet a specification which requires swash plate compressors to operate at a high surface pressure, the swash plate compressor of the present invention is preferable for the use of carbon dioxide or HFC1234yf as its refrigerant.

MODE FOR CARRYING OUT THE INVENTION

Figure 1:
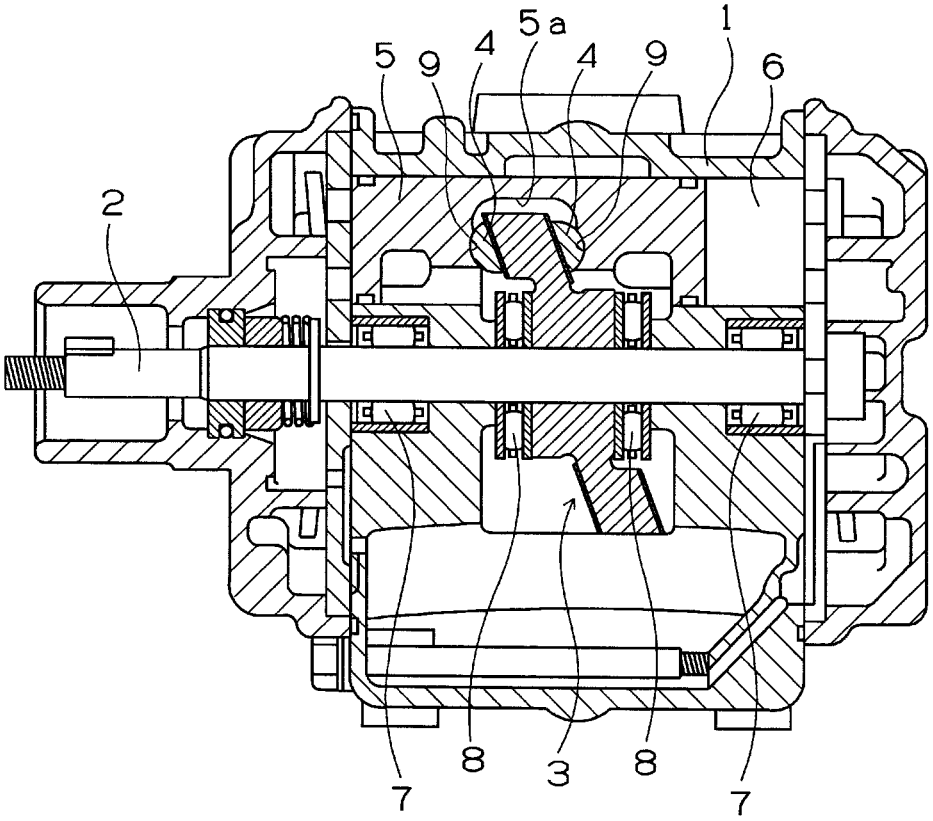
FIG. 1 is a vertical sectional view showing an example of a swash plate compressor of the present invention.

One embodiment of the swash plate compressor of the present invention is described below with reference to the drawings. FIG. 1 is a vertical sectional view showing an example of the swash plate compressor of the present invention. In the swash plate compressor shown in FIG. 1 which is of a double swash plate type, carbon dioxide is used as a refrigerant. The swash plate compressor is so constructed that inside a housing 1 where a refrigerant is present, the refrigerant is compressed and expanded at both sides of each of double head type pistons 5 formed inside a cylinder bore 6 by disposing the pistons 5 at regular intervals in the circumferential direction of the housing 1 by converting a rotational motion of a swash plate 3 mounted obliquely on a rotational shaft 2 by directly fixing the swash plate 3 to the rotational shaft 2 into a reciprocating motion of the pistons 5 through a shoe 4 which slides on both side surfaces of the swash plate 3. The rotational shaft 2 to be driven at a high speed is supported by a needle roller bearing 7 in its radial direction and by a thrust needle roller bearing 8 in its thrust direction.

The swash plate 3 may be indirectly fixed to the rotational shaft 2 via a coupling member. The swash plate 3 may be mounted on the rotational shaft 2 not obliquely but perpendicularly thereto. The main characteristic of the swash plate for the swash plate compressor of the present invention is that a predetermined resin film is formed on a sliding contact surface of the swash plate on which the shoe slides. Therefore the swash plate of the present invention is applicable to the swash plate compressors having the above-described modes.

A concave portion 5*a* is formed on each piston 5 in such a way that the concave portion 5*a* strides over an outer peripheral portion of the swash plate 3. A semispherical shoe 4 is seated on a spherical seat 9 formed on a surface axially opposed to the concave portion 5*a* and supports the pistons 5 movably relative to the rotation of the swash plate 3. Thereby the rotating motion of the swash plate 3 can be smoothly converted into the reciprocating motions of the pistons 5. As necessary, the surface of the shoe 4 may be nickel-plated or the like to improve the sliding property thereof.

A base material 3*a* of the swash plate 3 is not limited to a specific one, but it is preferable to use SAPH440C because it can be subjected to pressing processing and thereby it is possible to simplify the process of producing the swash plate 3 and decrease the production cost thereof, which is preferable.

The base material 3*a* of the swash plate 3 consists of a rolled steel plate disk-shaped by subjecting the steel plate to pressing processing. Both surfaces of the disk-shaped steel plate are subjected to grinding processing to form both surfaces thereof as sliding contact surfaces on which the shoe 4 slides. By performing the grinding processing with a double head grinding machine, it is possible to process the parallelism between both surfaces of the base material of the swash plate with high accuracy. As the grinding processing method to be carried out by using the double head grinding machine, it is possible to adopt a drive-type double head grinding method of simultaneously grinding the upper and lower surfaces of the disk-shaped steel plate which are sliding contact surfaces with a grinding stone while the disk-shaped steel plate is being rotated with its axis being held. The above-described grinding processing allows the flatness degree of the surface of the base material of the swash plate to be high. Thereby it is possible to decrease nonuniformity in the thickness of the resin film formed on both surfaces of the swash plate and easy to control the thickness thereof so as to prevent the thickness thereof from becoming nonuniform at the step of performing grinding processing of the resin film.

In addition to the above-described grinding processing, it is preferable to subject the base material of the swash plate to shot blast treatment at a portion thereof, constituting the ground of the resin film, which is disposed directly under the resin film. Thereby the strength of the adhesion between the base material 3*a* and the resin film is allowed to be high without forming an intermediate layer such as a thermal sprayed metal layer on the base material 3*a*. In addition, the resin film is unlikely to peel off the base material 3*a*. Further non-formation of the thermal sprayed metal layer leads to cost reduction and prevent the deterioration of the flatness degree of the swash plate.

Figure 2:
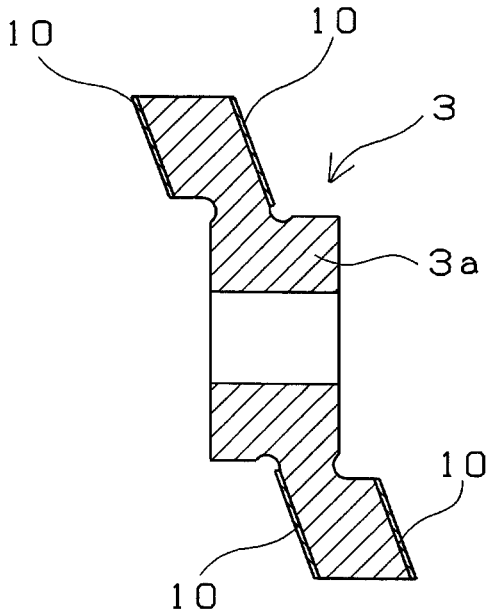
FIG. 2 is a sectional view showing an enlarged swash plate shown in FIG. 1.
Figure 3:
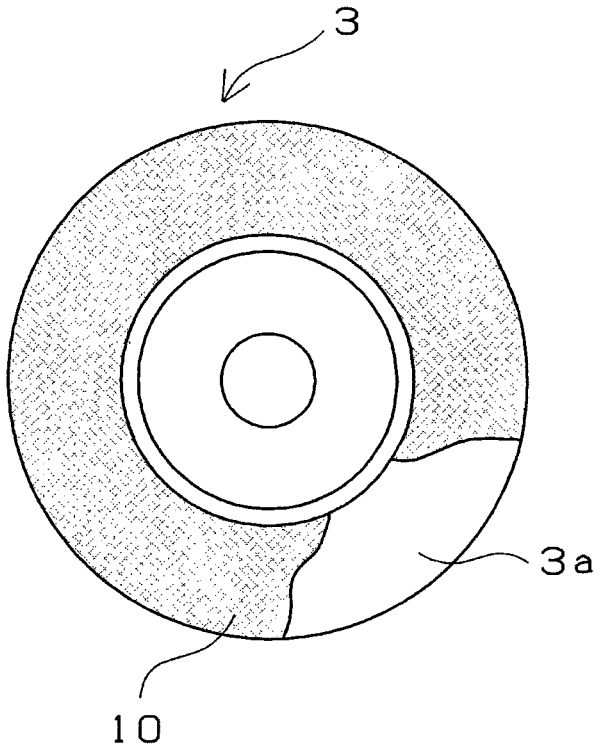
FIG. 3 is a partial cutaway view of the swash plate shown in FIG. 1.

As shown in FIGS. 2 and 3, a resin film containing a matrix resin and at least fluororesin and graphite is formed on the sliding contact surface of the base material 3*a* of the swash plate 3 on which the shoe 4 slides, namely, the surfaces of both side surfaces of the base material 3*a*. The present invention is characterized in that the resin film 10 contains 25 to 70 parts by weight of the fluororesin and 1 to 20 parts by weight of the graphite for 100 parts by weight of the matrix resin and that the tensile shear adhesive strength (conforming to JIS K6850) of the resin film 10 is not less than 25 MPa (preferably not less than 30 MPa). By forming the above-described resin film on the swash plate 3, the swash plate 3 can be used without the resin film 10 peeling off the swash plate 3 even in the case where a surface pressure applied to the swash plate 3 is not less than 10 MPa. Thus the swash plate 3 is capable of satisfying its low friction property, wear resistance, cavitation resistance in the presence of lubricating oil, and the strength of the adhesion of the resin film to the swash plate 3 in a favorable balance.

As the matrix resin, it is possible to use heat-resistant resins which do not thermally deteriorate when the swash plate is in use and allow fluororesin powders to bind with one another and the resin film to firmly adhere to the base material of the swash plate. As the matrix resin, polyphenylene sulfide resin, polyether ether ketone resin, polyimide resin, polyamide resin, PAI resin, epoxy resin, and phenol resin are listed. Of these matrix resins, it is preferable to use the PAI resin because the PAI resin is excellent in its heat resistance, wear resistance, and adhesion to the base material of the swash plate.

The PAI resin has an imide bond and an amide bond in its polymeric main chain. Of the PAI resins, aromatic PAI resin in which the imide bond and the amide bond are bonded to each other via an aromatic group is preferable. In the case where the matrix resin is the aromatic PAI resin, the matrix resin is excellent in its property of binding with the base material, of the swash plate constituting the ground of the resin film, which is disposed under the resin film and allows the obtained resin film to be especially excellent in its heat resistance. The imide bond of the aromatic PAI resin may be a precursor such as polyamide acid, a ring-closing imide ring or have a state in which the precursor and the ring-closing imide ring are mixed with each other.

The above-described aromatic PAI resin includes PAI resin to be produced from aromatic primary diamine, for example, diphenylmethane diamine and aromatic tribasic acid anhydride, for example, mono or diacyl halide derivative of trimellitic acid anhydride and from the aromatic tribasic acid anhydride and an aromatic diisocyanate compound, for example, diphenylmethane diisocyanate. In addition, as the PAI resin having the imide bond at a higher ratio than the amide bond, PAI resin is produced from an aromatic, aliphatic or alicyclic diisocyanate compound, an aromatic tetrabasic acid dianhydride, and an aromatic tribasic acid anhydride. Any of the above-described PAI resins can be used.

It is possible to use fluororesin which has a low friction, is capable of imparting unadhesiveness to the resin film, and is heat-resistant to such an extent that the resin film is capable of withstanding an ambient air temperature at which the swash plate is used. As the fluororesin, PTFE resin, a tetrafluoroethylene-perfluoroalkyl vinyl ether (PFA) copolymer resin, a tetrafluoroethylene-hexafluoropropylene (FEP) copolymer resin, and a tetrafluoroethylene-ethylene (ETFE) copolymer resin are listed. Of these fluororesins, it is preferable to use the powder of the PTFE resin. The PTFE resin is as high as $10^{10}$ to $10^{11}$ Pa·s in its melt viscosity at 340° C. to 380° C., is unlikely to flow at temperatures higher than its melting point, is most heat-resistant of all fluororesins, shows excellent properties at low temperatures, and is excellent in its friction and wear property.

As the PTFE resin, it is possible to use PTFE resin, commonly used, which is shown by $—(CF_2—CF_2)_n—$. It is also possible to use modified PTFE resin composed of the PTFE resin, commonly used, into which a perfluoroalkyl ether group ($C_pF_{2p}—O—$) (p is integers of 1 through 4) or a polyfluoroalkyl group ($H(CF_2)_q—$) (q is integers of 1 to 20) is introduced. It is possible to use the PTFE resin and the modified PTFE resin obtained by adopting common methods such as a suspension polymerization method of obtaining molding powder and an emulsification polymerization method of obtaining fine powder.

The average particle diameter (value measured by laser analysis method) of the PTFE resin powder is not specifically limited, but set to preferably not more than 30 μm to keep the surface smoothness of the resin film.

It is possible to use the PTFE resin powder obtained by calcining the PTFE resin at temperatures not less than its melting point. It is also possible to use the PTFE resin powder obtained by irradiating the calcined powder with γ rays or electron rays. The calcined PTFE resin powder is superior to uncalcined PTFE resin powder (molding powder, fine powder) because the former disperses in resin paint which forms the resin film more uniformly than the latter and the resin film containing the former is superior to the resin film containing the latter.

The resin film contains 25 to 70 parts by weight of the fluororesin such as the PTFE resin for 100 parts by weight of the matrix resin. When the mixing amount of the fluororesin is less than 25 parts by weight, there is a fear that the resin film is not excellent in its low friction property and that wear is accelerated by generated heat. Moreover the workability in coating the base material of the swash plated with the resin film. On the other hand, when the mixing amount of the fluororesin exceeds 70 parts by weight, the resin film is excellent in its low friction property, but has a low strength and wear resistance. Thus under an extreme pressure generated when the shoe locally contacts the swash plate 3, there is a fear that abnormal wear occurs. When the mixing amount of the fluororesin is set to 40 to 50 parts by weight, the tensile shear adhesive strength of the resin film exceeds 35 MPa.

Thus it is possible to secure a safety rate for the condition in which the extreme pressure is generated owing to the local contact of the shoe with the swash plate 3 when the shoe 4 makes a sliding contact with the swash plate 3. That the mixing amount of the fluororesin exceeds 70 parts by weight for 100 parts by weight of the matrix resin means a case in which converting the mixing amount of the fluororesin into the amount contained in the resin film, the mixing amount thereof exceeds about 40 wt %.

It is well known that the graphite has an excellent property as a solid lubricant and is used as the solid lubricant for the swash plate. The graphite is classified into natural graphite and artificial graphite. As the configuration of the graphite, there exist a flaky shape, a granular shape, and a spherical shape. It is possible to use the graphite having any of the above-described shapes. It is considered that the artificial graphite is unsuitable as a lubricant because its lubricating performance is inhibited by carborundum generated during a production step and because it is difficult to produce graphite having a high degree of graphitization. Because the natural graphite completely graphitized is yielded, it has a very high lubricating property and is thus suitable as the solid lubricant. But the natural graphite contains a large amount of impurities which deteriorate the lubricating property. Although it is necessary to remove the impurities, it is difficult to completely remove them.

It is favorable to use graphite composed of not less than 97.5% of fixed carbon and more favorable to use artificial graphite composed of not less than 98.5% of the fixed carbon. The graphite containing the fixed carbon at the above-described rates has an affinity for the lubricating oil. Thus even though the graphite does not have the lubricating oil attaching to the surface thereof, its lubricating property is maintained by a slight amount of the lubricating oil impregnated therein.

1 to 20 parts by weight of the graphite is mixed with 100 parts by weight of the matrix resin of the resin film to modify the friction and wear property of the resin film. When the mixing amount of the graphite is less than one part by weight, the effect of modifying the friction and wear property of the resin film cannot be obtained even though the graphite is added to the matrix resin. On the other hand, when the mixing amount of the graphite exceeds 20 parts by weight, the graphite impairs the adhesion of the resin film to the base material of the swash plate, which causes the resin film to peel off the base material of the swash plate. When the total of the addition amount of the additives including the fluororesin, the graphite, and other additives is less than 15 parts by weight for 100 parts by weight of the matrix resin, the resin film is nonuniform in its thickness. Thus it is difficult to obtain a required dimensional accuracy.

In addition to the matrix resin, the fluororesin, and the graphite, the resin film may contain other additives in a range in which they do not outstandingly deteriorate the necessary properties of the swash plate of the present invention. In the case where the resin film is formed of three components, namely, the matrix resin, the fluororesin, and the graphite, the resin film is capable of obtaining its tensile shear adhesive strength, low friction property, wear resistance, and cavitation resistance in the most favorable balance.

In the case where the PAI resin is used as the matrix resin of the resin film, the PTFE resin is used as the fluororesin, and the graphite composed of not less than 97.5% of the fixed carbon is used, these resins and the graphite are easily obtainable and comparatively inexpensive, which leads to cost reduction of the swash plate.

Because the compressor has become lightweight and compact recently, the specification of the compressor requires that the swash plate is compact and operated at a high speed and under a high load to maintain a high output. Because in an operation performed at a high speed and under a high load in the presence of the lubricating oil, the cavitation is liable to occur. Thus the resin film is demanded to have the cavitation resistance to prevent the occurrence of the cavitation-caused erosion. To keep the cavitation resistance, it is necessary to increase the mixing ratio of the PAI resin to be used as the matrix resin to that of the solid lubricant. When the mixing amount of the fluororesin exceeds 70 parts by weight, the mixing ratio of the matrix resin playing the roll of a binder becomes low. Thereby the cavitation resistance is insufficient. When the total of the addition amounts of the additives including as the fluororesin, the graphite, and other additives for 100 parts by weight of the matrix resin exceeds 90 parts by weight, the erosion of the resin film caused by the cavitation is liable to occur. On the other hand, by setting the total of the addition amounts of the above-described components to not less than 90 parts by weight, the cavitation resistance is secured, which is desirable.

The resin film of the present invention is formed by spray-coating the swash plate with the resin paint. The resin film can be also formed by roll-coating the swash plate with the resin paint. The resin paint is obtained by dispersing or dissolving the solid contents, namely, the matrix resin, the fluororesin, and the graphite in solvents at the above-described mixing rates. As the solvents, it is possible to use ketones such as acetone, methyl ethyl ketone; esters such as methyl acetate and ethyl acetate; aromatic hydrocarbons such as toluene and xylene; organic halogen compounds such as methylchloroform, trichloroethylene, and trichlorotrifluoroethane; and non-proton extreme solvents such as N-methyl-2-pyrrolidone (NMP), methylisopyrrolidone (MIP), dimethylformamide (DMF), dimethylacetamide (DMAC). These solvents can be used singly or as mixtures thereof.

The thickness of the resin film hardened and adhered to the base material by spray-coating or roll-coating the base material of the swash plate with the resin paint and calcining the resin paint is set to 20 μm to 50 μm after the resin paint is calcined. The resin film having the thickness of 20 μm to 50 μm is processed by using a double head grinding machine to set the thickness thereof to 8 μm to 30 μm, the flatness thereof to not more than 15 μm, and the parallelism thereof to not more than 15 μm as the final accuracy of finish thereof. Because the resin film is subjected to the grinding processing (finish processing) by the double head grinding machine, it is possible to process the parallelism between both sliding contact surfaces of the swash plate with high accuracy. In addition, because the base material of the swash plate which constitutes the ground of the resin film is excellent in its dimensional accuracy, it is possible to secure the dimensional uniformity of the resin film, achieve a stable boundary lubrication state by the lubricating oil, and stabilize friction and wear property thereof in the boundary lubrication state when the lubricating oil is depleted.

The surface roughness of the resin film can be altered according to the count of a grinding stone and is set to favorably 0.1 to 1.0 μmRa. When the surface roughness thereof is less than 0.1 μmRa, the lubricating oil is insufficiently supplied to the sliding contact surface. When the surface roughness thereof exceeds 1.0 μmRa, an actual contact area of the sliding contact surface becomes small. As a result, the surface pressure applied to the sliding contact surface becomes locally high and thus there is a fear that the sliding contact surface seizes. The surface roughness of the resin film is set to more favorably 0.2 to 0.8 μmRa.

Figure 4:
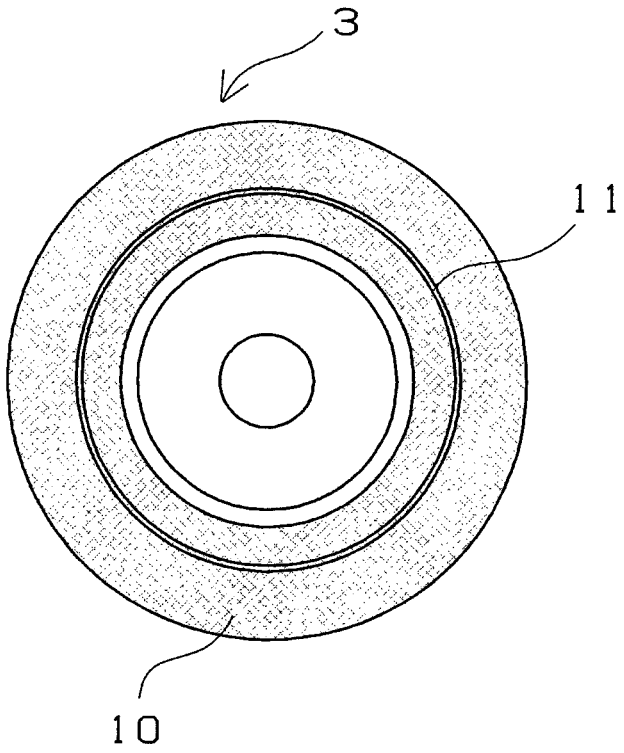
FIG. 4 is a side view showing a swash plate where an oil pocket is formed.

To compensate the lubricating action at a time when the sliding contact surface of the swash plate is lubricated by dilute lubricating oil, it is preferable to form an oil pocket on the sliding contact surface of the swash plate 3 on which the shoe 4 slides. As the form of the oil pocket, a spotty or streaky concave portion is exemplified. As the spotty or streaky configuration, parallel linear, lattice-shaped, spiral, radial, and circular configurations are exemplified. It is desirable to form the oil pocket during the production of the base material of the swash plate. It is possible to form the oil pocket by turning processing after the pressing processing finishes. As shown in FIG. 4, it is preferable to form a concave portion (circumferential groove) 11 which has a width of 0.5 mm to 8 mm on the swash plate of the present invention as the oil pocket and is concentric with the center of the swash plate. In this case, it is preferable that the position of the circumferential groove is coincident with the central portion of the shoe which slides on the swash plate. It is preferable to set the depth of the oil pocket to 0.1 mm to 1 mm.

It is favorable to set the area of a plain portion of the sliding contact surface of the swash plate on which the shoe slides to 10 to 95% (surface contact ratio) of the entire area of the sliding contact surface except the area of the oil pocket. It is more favorable to set the surface contact ratio to 30 to 80%. When the surface contact ratio is less than 10%, there is a fear that the plain portion plastically deforms owing to a pressure applied to the contacted surface of the plain portion and that of the shoe. When the plain portion of the sliding contact surface exceeds 95%, the amount of the lubricating oil to be held by the oil pocket is short. Thus the effect to be obtained by forming the oil pocket is small.

The most favorable form of the oil pocket is the circumferential groove which is concentric with the center of the swash plate, has a width of 0.5 mm to 8 mm, a depth of 0.1 mm to 1 mm, and has 30 to 70% in the contact ratio of the area of a portion of the circumferential groove on which the shoe slides to the area of the entire circumferential groove.

The swash plate compressor of the present invention has the swash plate having the above-described form. Therefore in the case where a shoe having a small diameter locally contacts the swash plate, in the case where an inexpensive shoe which is made of SUJ2 or the like and is not specially treated is used, and in the case where the lubricating oil is depleted, the swash plate is excellent in its resistance to the occurrence of the seizing. In addition, it is possible to prevent the cavitation-caused erosion of the resin film when the swash plate is operated at a high surface pressure and a high speed in the presence of the lubricating oil. Further it is possible to produce the swash plate compressor at a low cost.

EXAMPLES

Examples 1 through 8

After a steel plate of each example made of SAPH440C was molded into the shape of a disk by pressing processing, rough processing was performed to set the thickness of each disk to thickness 6.5 mm, diameter 90 mm by using a lathe. Thereafter both surfaces of the disk was ground by using the double head grinding machine (grinding stone: #80) to set its flatness to not more than 5 μm, parallelism to not more than 5 μm, and thickness to 6.36 mm. Thereafter both ground surfaces of the base material of the disk were shot blasted (Rz: target was 5.0 μm) to enhance the surface roughness of both ground surfaces thereof. Thereafter each resin paint having the mixing ratio shown in table 1 was applied to both shot blasted surfaces of the base material of each disk by using a spray-coating method to such an extent that the resin paint was deposited in a thickness of 30 μm after the resin paint was calcined. After the resin paint was calcined at 240° C., both surfaces of the base material of the disk were ground by using the double head grinding machine (grinding stone: for resin #400) to perform final finish processing (flatness was set to not more than 15 μm, parallelism was set to not more than 15 μm, thickness was set to 6.40 mm, and surface roughness was set to 0.6 to 0.7 μmRa). In this manner, specimens of the examples were obtained. In the examples 4 and 5, in machining each base material with the lathe, a predetermined circular groove was formed concentrically with the center of the disk by spacing the circular groove at a certain interval from the center of the disk (see FIG. 4). The circumferential groove was disposed in coincidence with the central portion of the shoe which slides thereon.

The solid content of each of the resin paints is as shown below. As the resin paint, PAI resin varnish in which the PAI resin was dispersed in N-methylpyrrolidone was used. After PTFE resin and graphite powder were added to the PAI resin varnish, the solution was diluted.

(a) PTFE: PTFE resin (average particle diameter: 10 μm, calcined material)

(b) PAI: article having a glass transition temperature of 245° C.

(c) Graphite powder: artificial graphite (average particle diameter: 10 μm)

Examples 9 through 12

The base material of each of the examples was processed by using the same method as that of the example 1. Each resin paint having the same mixing ratio as that of the example 3 shown in table 1 was applied to both surfaces of the base material to such an extent that the resin paint was deposited in the thickness of 30 μm by using the spray-coating method after the resin paint was calcined. After the resin paint was calcined, both surfaces of the base material of each disk were ground by using a surface grinder to perform final finish processing (flatness was set to not more than 15 μm, parallelism was set to not more than 15 μm, thickness was set to 6.40 mm). In this manner, specimens of the examples were obtained. Thereafter four kinds of grinding stones (#2000, #600, #230, #120: for resin) were used to differentiate the surface roughnesses of the specimens from one another.

Comparative Examples 1 through 5

The base material of each of comparative examples was processed by using the same method as that of the example 1. Each resin paint having the same mixing ratio shown in table 2 was applied to both surfaces of each base material to such an extent that the resin paint was deposited in the thickness of 30 μm by using the spray-coating method after the resin paint was calcined. After the resin paint was calcined, both surfaces of the base material of each disk were ground by using the surface grinder to perform final finish processing (flatness was set to not more than 15 μm, parallelism was set to not more than 15 μm, thickness was set to 6.40 mm, and surface roughness was set to 0.6 to 0.7 μmRa). In this manner, specimens of the comparative examples were obtained. "Surface roughness of resin film" shown in tables 1 and 2 shows the average of values measured at five points of the ground surface of each specimen.

<Friction and Wear Test>

A friction and wear test in which three steel shoes (SUJ2, 913 mm (effective sliding portion)) were slid on the specimen of each of the examples and the comparative examples was conducted by using a thrust testing machine (3 shoe on type) to measure the coefficient of friction of each specimen after a lapse of 60 minutes. The test conditions are as shown below.

Load: 400N

Sliding-contact speed: 32 m/minute

Lubricating condition: dry method

Test period of time: 60 minutes

<Limit Surface Pressure Test>

By using the same thrust testing machine (3 shoe on type) as that used in the friction and wear test, the limit surface pressure was checked. The test conditions are as shown below. A surface pressure applied to the specimen one hour before a surface pressure at which the coefficient of friction suddenly fluctuated and the ground including a local portion was exposed was defined as a limit surface pressure (MPa). The limit surface pressure is judged as a withstanding force for a state in which the extreme pressure was generated owing to a local contact between the resin film and the shoe which slides thereon.

Surface pressure: Starting from 8 MPa, 1 MPa was imparted to each specimen every hour.

Sliding-contact speed: 25 m/second

Lubricating condition: Refrigerating oil was used (100° C., circulated)

<Tensile Shear Test>

To measure the strength of the resin film of each specimen, after the sliding contact surface of the specimen of each of the examples and the comparative examples was treated with a surface treatment agent (TETRA-H), each resin film was bonded to an SPCC steel material (SS400, 15×45×2 mm) with a two-component epoxy adhesive agent. As the adhesive conditions, after each specimen fixed at 0.5 MPa was put in an electric oven, it was left for 45 minutes at 110° C. to harden it. The bonded area was 2 $cm^2$. To measure the tensile shear adhesive strength (MPa) of each specimen, the metallic plate was pulled by a tension testing machine (autograph produced by Shimadzu Corporation) at a speed of 5 mm/minute. "Destruction of material" shown in the "peeled portion" of tables 1 and 2 means that the resin film was destroyed. "Interfacial peeling" shown in the "peeled portion" of table 2 means that the resin film peeled from the base material of the swash plate at the interface thereof.

<Cavitation Resistance Test>

An opposed-type cavitation test was conducted to evaluate the cavitation resistance of each specimen. The test conditions were as described below. A plain plate having a resin film formed on its surface was set in water. An oscillator was set directly over the plain plate. The oscillator was oscillated by ultrasonic waves to intentionally generate a cavitation to attack the resin film. In this manner, the durability of each specimen was evaluated. The state of the resin film after the test finished was checked visually and with a stylus-type shape measuring instrument. Specimens which had a slight erosion such as a color change which did not adversely affect the properties of the specimens were marked by "○". Specimens which were eroded in a depth less than 10 μm were marked by "Δ". Specimens which were eroded in a depth not less than 10 μm were marked by "x".

Frequency: 18 kHz

Test period of time: 10 minutes

Test environment: in water (normal temperature)

TABLE 1

| | Example | | | | | |
|---|---|---|---|---|---|---|
| | 1 | 2 | 3 | 4 | 5 | 6 |
| Composition (part by weight) | | | | | | |
| PAI resin | 100 | 100 | 100 | 100 | 100 | 100 |
| PTFE resin | 27 | 46 | 58 | 50 | 50 | 64 |
| Graphite | 7 | 8 | 8 | 17 | 17 | 18 |
| Groove on sliding contact surface | not formed | not formed | not formed | formed | formed | not formed |
| Dimension of grrove | | | | | | |
| Number of grooves | — | — | — | 1 | 1 | — |
| Width | — | — | — | 3 mm | 6.5 mm | — |
| Depth | — | — | — | 0.5 mm | 0.5 mm | — |
| Ratio of contact of swash plate with shoe | 100% | 100% | 100% | 79% | 55% | 100% |
| Surface roughness of resin film, μmRa | 0.69 | 0.68 | 0.66 | 0.69 | 0.67 | 0.68 |
| Grinding stone for resin | # 400 | # 400 | # 400 | # 400 | # 400 | # 400 |
| Tensile shear adhesive strength, Mpa | 40 | 36 | 30 | 36 | 36 | 34 |
| Peeled portion | Destruction of material | Destruction of material | Destruction of material | Destruction of material | Destruction of material | Destruction of material |
| Coefficient of friction | 0.23 | 0.22 | 0.21 | 0.20 | 0.18 | 0.19 |
| Limit surface pressure, Mpa | 14 | 13 | 12 | 13 | 14 | 14 |
| Cavitation resistance | ○ | ○ | ○ | ○ | ○ | Δ |

| | Example | | | | | |
|---|---|---|---|---|---|---|
| | 7 | 8 | 9 | 10 | 11 | 12 |
| Composition (part by weight) | | | | | | |
| PAI resin | 100 | 100 | 100 | 100 | 100 | 100 |
| PTFE resin | 25 | 70 | 58 | 58 | 58 | 58 |
| Graphite | 1 | 8 | 8 | 8 | 8 | 8 |
| Groove on sliding contact surface | not formed | not formed | not formed | not formed | not formed | not formed |
| Dimension of grrove | | | | | | |
| Number of grooves | — | — | — | — | — | — |
| Width | — | — | — | — | — | — |
| Depth | — | — | — | — | — | — |

TABLE 1-continued

| | | | | | | |
|---|---|---|---|---|---|---|
| Ratio of contact of swash plate with shoe | 100% | 100% | 100% | 100% | 100% | 100% |
| Surface roughness of resin film, μmRa | 0.65 | 0.68 | 0.39 | 0.94 | 0.07 | 1.06 |
| Grinding stone for resin | # 400 | # 400 | # 600 | # 230 | # 2000 | # 120 |
| Tensile shear adhesive strength, Mpa | 43 | 26 | 30 | 30 | 30 | 30 |
| Peeled portion | Destruction of material | Destruction of material | Destruction of material | Destruction of material | Destruction of material | Destruction of material |
| Coefficient of friction | 0.25 | 0.17 | 0.20 | 0.21 | 0.23 | 0.21 |
| Limit surface pressure, Mpa | 11 | 14 | 13 | 12 | 10 | 10 |
| Cavitation resistance | ○ | Δ | ○ | ○ | ○ | ○ |

TABLE 2

| | Comparative example | | | | |
|---|---|---|---|---|---|
| | 1 | 2 | 3 | 4 | 5 |
| Composition (part by weight) | | | | | |
| PAI resin | 100 | 100 | 100 | 100 | 100 |
| PTFE resin | 12 | 73 | 111 | 67 | 53 |
| Graphite | 6 | 9 | 11 | 0 | 26 |
| Groove on sliding contact surface | not formed | not formed | not formed | not formed | not formed |
| Dimension of grrove | | | | | |
| Number of grooves | — | — | — | — | — |
| Width | — | — | — | — | — |
| Depth | — | — | — | — | — |
| Ratio of contact of swash plate with shoe | 100% | 100% | 100% | 100% | 100% |
| Surface roughness of resin film, μmRa | 0.66 | 0.68 | 0.67 | 0.68 | 0.67 |
| Grinding stone for resin | # 400 | # 400 | # 400 | # 400 | # 400 |
| Tensile shear adhesive strength, Mpa | — | 22 | 17 | 29 | 18 |
| Peeled portion | — | Destruction of material | Interfacial peeling | Destruction of material | Destruction of material |
| Coefficient of friction | — | 0.19 | 0.18 | 0.22 | 0.18 |
| Limit surface pressure, Mpa | — | 8 | 7 | 7 | 8 |
| Cavitation resistance | ○ | X | X | X | Δ |

The specimen of each of the examples was stable in the coefficients of friction thereof up to 60 minutes from the beginning of the test and had a favorable balance among its limit surface pressure (wear property) and cavitation resistance, and the strength of the adhesion of the resin film to the swash plate. The specimens of the examples 4 and 5 which had the groove formed thereon were lower in the coefficients of friction thereof and had a favorable balance among the above-described properties. The specimens of the examples 1 through 10 having surface roughnesses thereof set to 0.1 to 1.0 μmRa had a higher limit surface pressure (wear property) than the specimen of the example 11 having its surface roughness set to less than 0.1 μmRa and than the specimen of the example 12 having its surface roughness set to more than 1.0 μmRa.

On the other hand, because the specimen of the comparative example 1 was nonuniform in its thickness, the tests were not conducted except the cavitation resistance test. The specimens of the comparative examples 2 and 3 had a low coefficient of friction respectively, but the limit surface pressures thereof did not reach 10 MPa. The specimen of the comparative example 4 not containing the graphite and the specimen of the comparative example 5 having a very large amount of the graphite were inferior in the limit surface pressures thereof.

The above-described results indicate that the swash plate of the present invention has a sufficiently favorable balance among its low friction property, wear resistance, the strength of adhesion of the resin film, and cavitation resistance. The above-described results also indicate that the swash plate of the present invention is excellent in its wear resistance at an extreme pressure generated owing to the local contact between the swash plate and the shoe which slides thereon and in the resistance to the occurrence of the seizing in the condition where the refrigerant oil is depleted. It is also understood that the swash plate of the present invention is sufficiently durable in the case where the swash plate is used for the swash plate compressor in which the pressure reaches as high as 10 MPa owing to the use of the carbon dioxide as the refrigerant. It is also understood that the oil pocket formed on the sliding contact surface of the swash plate allows a low friction to be achieved between the sliding contact surface of the swash plate and the shoe which slides thereon. Thereby it has been confirmed that the swash plate of the present invention is more economical (low cost) than conventional swash plates and in addition, serves as an effective means for obtaining a stable boundary lubrication state in the condition in which the extreme pressure is generated because the shoe locally contacts the swash plate during the operation of the swash plate compressor and in the condition in which the lubricating oil is depleted.

INDUSTRIAL APPLICABILITY

The swash plate of the present invention for the swash plate compressor is capable of satisfying its low friction property, wear resistance, cavitation resistance, cost, and the strength of the adhesion of the resin film to the swash plate in a favorable balance. Therefore the swash plate of the present invention can be preferably utilized for a swash plate compressor which has been recently produced according to a specification describing that carbon dioxide is used as its refrigerant and that the swash plate compressor is operated at a high speed and under a high load.

EXPLANATION OF REFERENCE NUMERALS AND SYMBOLS

1: housing
2: rotational shaft
3: swash plate
3*a*: base material
4: shoe
5: piston
5*a*: concave portion
6: cylinder bore
7: needle roller bearing
8: thrust needle roller bearing
9: spherical seat
10: resin film
11: concave portion (circumferential groove)

The invention claimed is:

1. A swash plate for a swash plate compressor comprising a housing containing a refrigerant, said refrigerant being compressed and expanded by converting a rotational motion of said swash plate mounted perpendicularly and obliquely on a rotational shaft by directly fixing said swash plate to said rotational shaft or indirectly fixing said swash plate to said rotational shaft through a coupling member into a reciprocating motion of a piston through a shoe which slides on said swash plate;

wherein said swash plate has cavitation resistance; a base material of said swash plate consists of a disk-shaped steel plate; a resin film containing matrix resin and at least fluororesin and graphite is formed on said sliding contact surface of said swash plate on which said shoe slides; said resin film being directly on said disk-shaped steel plate without an intermediate layer; and said resin film contains 25 to 70 parts by weight of said fluororesin and 1 to 20 parts by weight of said graphite for 100 parts by weight of said matrix resin and has a tensile shear adhesive strength of not less than 25 MPa.

2. The swash plate for a swash plate compressor according to claim 1, wherein said matrix resin is polyamideimide resin.

3. The swash plate for a swash plate compressor according to claim 1, wherein said fluororesin is polytetrafluoroethylene resin; and said graphite is composed of not less than 97.5% of fixed carbon.

4. The swash plate for a swash plate compressor according to claim 3, wherein said graphite is artificial graphite composed of not less than 98.5% of said fixed carbon.

5. The swash plate for a swash plate compressor according to claim 1, wherein a base material of said swash plate is subjected to shot blast treatment at a portion thereof, constituting a ground of said resin film, which is disposed directly under said resin film.

6. The swash plate for a swash plate compressor according to claim 5, wherein said base material of said swash plate consists of SAPH440C.

7. The swash plate for a swash plate compressor according to claim 5, wherein said base material of said swash plate consists of a rolled steel plate disk-shaped by subjecting said steel plate to pressing processing; and both surfaces of said disk-shaped steel plate is subjected to grinding processing and thereafter said shot blast treatment.

8. The swash plate for a swash plate compressor according to claim 7, wherein said grinding processing is performed by a double head grinding machine.

9. The swash plate for a swash plate compressor according to claim 1, wherein a surface of said resin film is subjected to grinding processing by a double head grinding machine.

10. The swash plate for a swash plate compressor according to claim 9, wherein said grinding processing is carried out by a drive-type double head grinding method of simultaneously grinding upper and lower surfaces of said disk-shaped steel plate which are sliding contact surfaces with a grinding stone, while said disk-shaped steel plate is being rotated with its axis being held.

11. The swash plate for a swash plate compressor according to claim 9, wherein a flatness of said surface of said resin film subjected to said grinding processing is set to not more than 15 μm and a parallelism of said surface thereof is set to not more than 15 μm.

12. The swash plate for a swash plate compressor according to claim 9, wherein a surface roughness of said resin film subjected to said grinding processing is 0.1 to 1.0 μmRa.

13. The swash plate for a swash plate compressor according to claim 1, wherein said swash plate has an oil pocket on a sliding contact surface thereof on which said shoe slides.

14. The swash plate for a swash plate compressor according to claim 13, wherein an area of a plain portion of said sliding contact surface of said swash plate on which said shoe slides is set to 10 to 95% of an entire area of said sliding contact surface excluding an area of said oil pocket.

15. The swash plate for a swash plate compressor according to claim 13, wherein a depth of said oil pocket is set to 0.1 mm to 1 mm.

16. The swash plate compressor comprising a housing containing a refrigerant, said refrigerant being compressed and expanded by converting a rotational motion of said swash plate into a reciprocating motion of a piston through a shoe which slides on said swash plate mounted perpendicularly and obliquely on a rotational shaft by directly fixing said swash plate to said rotational shaft or indirectly fixing said swash plate to said rotational shaft through a coupling member into a reciprocating motion of a piston through a shoe which slides on said swash plate, wherein said swash plate is as claimed in claim 1.

17. The swash plate compressor according to claim 16, wherein said refrigerant is carbon dioxide.

* * * * *